US008348631B2

(12) United States Patent
Paluncic et al.

(10) Patent No.: US 8,348,631 B2
(45) Date of Patent: Jan. 8, 2013

(54) LUBRICANT OR HYDRAULIC PUMP

(75) Inventors: Zdravko Paluncic, Ludwigshafen (DE); Andreas Schoenfeld, St. Leon-Rot (DE)

(73) Assignee: Lincoln GmbH, Walldorf (DE)

( * ) Notice: Subject to any disclaimer, the term of this patent is extended or adjusted under 35 U.S.C. 154(b) by 546 days.

(21) Appl. No.: 12/295,962

(22) PCT Filed: Mar. 15, 2007

(86) PCT No.: PCT/EP2007/002299
§ 371 (c)(1),
(2), (4) Date: Mar. 17, 2010

(87) PCT Pub. No.: WO2007/112837
PCT Pub. Date: Oct. 11, 2007

(65) Prior Publication Data

US 2010/0166581 A1 Jul. 1, 2010

(30) Foreign Application Priority Data

Apr. 5, 2006 (DE) ..... 20 2006 005 682 U

(51) Int. Cl.
*F04B 9/02* (2006.01)

(52) U.S. Cl. ..... 417/238; 417/239; 417/572; 92/71; 92/128; 92/129

(58) Field of Classification Search ..... 417/238, 417/239, 470, 572; 92/71, 128, 129
See application file for complete search history.

(56) References Cited

U.S. PATENT DOCUMENTS

| | | | | |
|---|---|---|---|---|
| 2,381,056 | A | 8/1945 | Huber | |
| 2,941,475 | A * | 6/1960 | Blair | 417/238 |
| 3,584,433 | A * | 6/1971 | Van Doorn et al. | 53/52 |
| 4,123,836 | A | 11/1978 | Buckell | |
| 4,640,144 | A * | 2/1987 | McLendon | 74/56 |
| 5,215,443 | A * | 6/1993 | Hani et al. | 417/269 |
| 5,897,300 | A | 4/1999 | Luedtke | |
| 5,931,079 | A * | 8/1999 | Kazahaya | 92/12.2 |
| 6,318,502 | B1 * | 11/2001 | Unger | 184/6.16 |
| 6,361,282 | B1 | 3/2002 | Wanschura | |
| 6,572,343 | B2 * | 6/2003 | Yokomachi et al. | 417/269 |
| 7,588,426 | B2 * | 9/2009 | De Palma et al. | 418/1 |
| 2004/0166002 | A1 * | 8/2004 | Lanfredi | 417/360 |

FOREIGN PATENT DOCUMENTS

DE 1173340 B 7/1964

(Continued)

OTHER PUBLICATIONS

German Search Report issued Jul. 13, 2006 with respect to the basic German Utility Model 20 2006 005 682.3, 4 pages. International Preliminary Report on Patentability dated Nov. 17, 2008, 8 pages.

*Primary Examiner* — Charles Freay
*Assistant Examiner* — Dominick L Plakkoottam
(74) *Attorney, Agent, or Firm* — Senniger Powers LLP

(57) ABSTRACT

The invention relates to a lubricant or hydraulic pump for delivering oil or the like having a housing which is formed from two housing shells which are of at least substantially similar or identical construction. An inlet is provided on or in the housing. Furthermore, a rotatably mounted drive element, which is configured, in particular, as a swash plate, and at least one pump element which interacts with the drive element to deliver oil or the like are arranged in the housing.

14 Claims, 2 Drawing Sheets

FOREIGN PATENT DOCUMENTS

| | | | |
|---|---|---|---|
| DE | 2412941 | A1 | 9/1974 |
| DE | 3921084 | A1 | 1/1991 |
| DE | 29611935 | U1 * | 9/1996 |
| DE | 19828180 | A1 | 1/2000 |
| EP | 0688953 | A2 | 12/1995 |
| EP | 1452733 | A1 | 9/2004 |
| FR | 2736688 | A3 | 1/1997 |

* cited by examiner

LUBRICANT OR HYDRAULIC PUMP

BACKGROUND OF THE INVENTION

The invention relates to a lubricant or hydraulic pump for delivering oil or the like with a housing, an inlet provided on or in the housing, a drive element mounted rotatably in the housing, and at least one pump element, which interacts with the drive element for delivering oil or the like.

Such pumps are used for delivering lubricant to lubricating points of machines or for delivering a hydraulic fluid. For example, such pumps are used for presses, in particular, packing presses. The configuration of such pumps is complicated, in part, by many different components. This makes the production of such pumps more expensive. In addition, it is often not possible to quickly adapt the number of pump elements in use to the individual requirements of the application, so that the possible applications of known pumps are somewhat limited.

The task of the present invention is therefore to create a lubricant or hydraulic pump of the type named above, which can be produced in an especially economical way and which can have various uses.

SUMMARY OF THE INVENTION

In general, this invention is directed to a lubricant or hydraulic pump for delivering oil or the like. The pump comprises a housing formed from two housing shells which are of at least substantially similar or identical construction, an inlet provided on or in the housing, and a drive element rotatably mounted in the housing. The drive element comprises a swash plate. The pump also includes at least one pump element which interacts with the drive element for delivering oil or the like.

Other advantages and possible applications of the invention result from the following description of embodiments and the figures. In this case, all described and/or graphically illustrated characteristics form the object of the invention individually or in arbitrary combinations, namely regardless of their combination in the claims or their reference to other characteristics.

DETAILED DESCRIPTION

Figure 2:
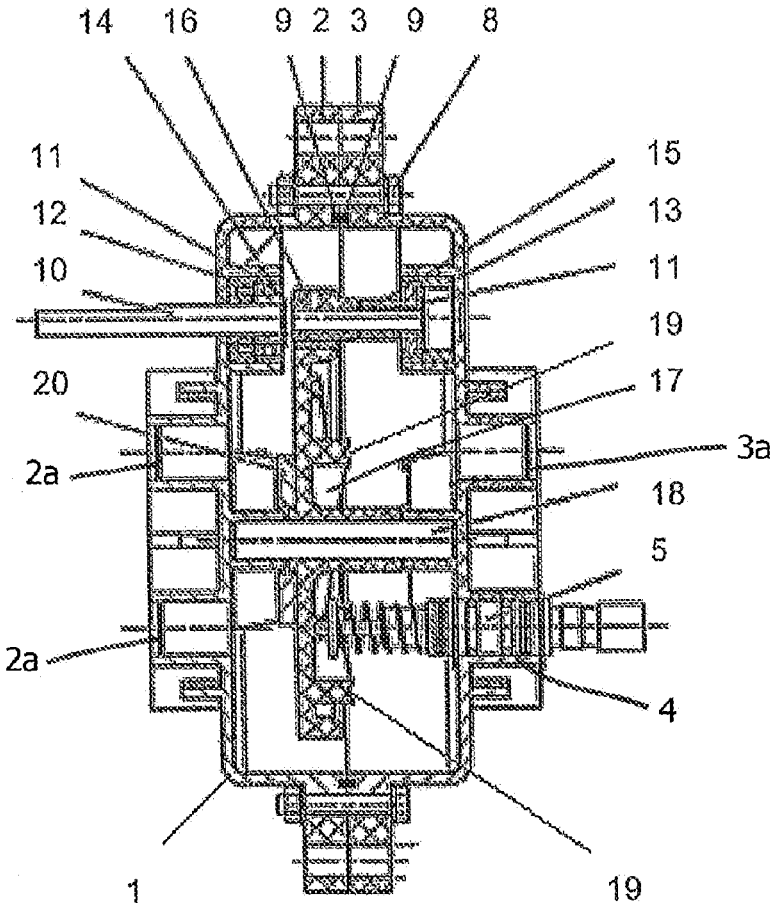
FIG. 2 is a section through the lubricant or hydraulic pump according to FIG. 1 along the line A-A.

The lubricant and hydraulic pump shown in the figures has a housing 1 which is built from two housing shells 2 and 3. The two housing shells 2 and 3 are structurally identical or similar at least before assembly of the housing and have several openings closed by predetermined breakage points comprising break-away portions 2*a*, 3*a* of the housing shells configured to be broken away from respective shells to form openings 4 for installation of one or more pump elements, drive or driven shafts, and/or inlets or outlets, as described below. As illustrated in FIG. 2, the break-away portions 2*a*, 3*a* are weakened portions of respective housing shells 2, 3 molded as integral (i.e., one-piece) parts of the shells.

Figure 1:
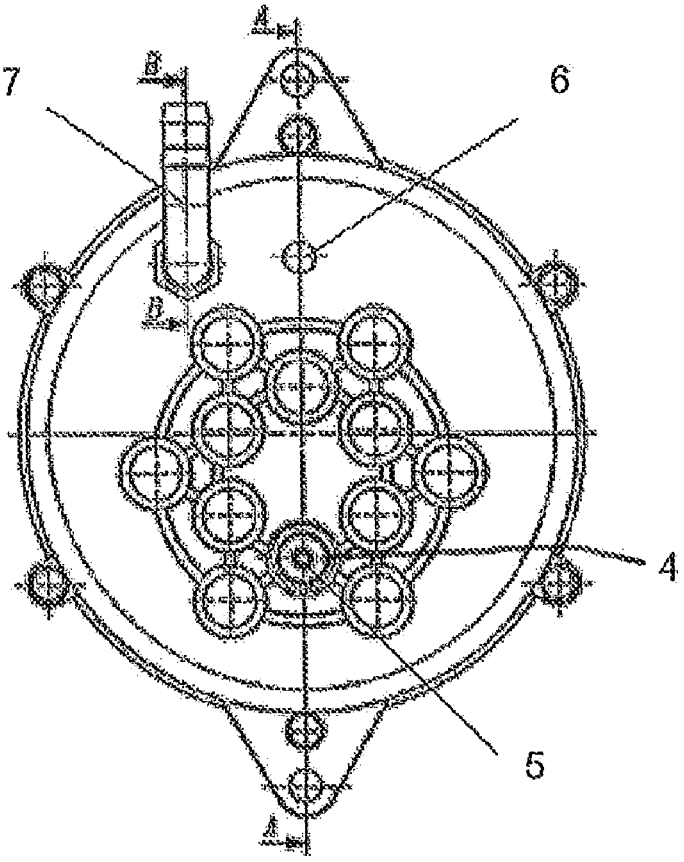
FIG. 1 is a side view of a lubricant or hydraulic pump according to the invention.
Figure 4:
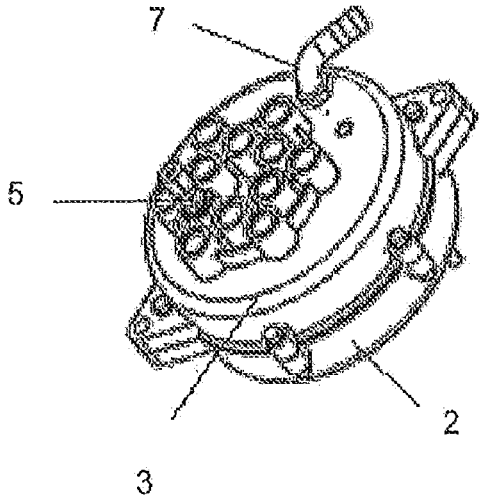
FIG. 4 is a in perspective view of the lubricant or hydraulic pump of FIG. 1.

Thus, as is visible, in particular, from FIGS. 1 and 4, several openings 4 are provided. They are arranged on two concentric paths. In the shown embodiment, a pump element 5 is installed in one of the openings 4 after a predetermined breakage point is opened. Furthermore, an opening 6 is provided as a ventilation opening. Alternatively, after opening the predetermined breakage point, a drive or driven shaft can also be inserted through such an opening. Also, for an inlet 7 there is a corresponding opening in the housing shells 2 and 3.

The two housing shells 2 and 3 are joined to each other in a mirror-image arrangement and are connected to each other by a screw attachment 8. Sealing rings 9 are provided between the two housing shells 2, 3 in order to seal the housing 1.

Figure 3:
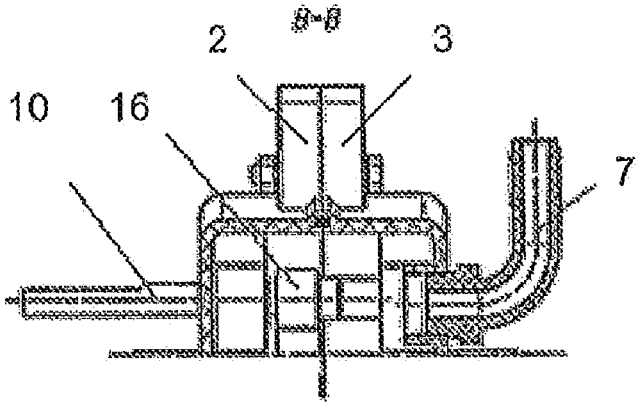
FIG. 3 is a section through the lubricant or hydraulic pump according to FIG. 1 along the line B-B.

As is visible from FIGS. 2 and 3, a drive shaft 10 leads into the housing 1. The drive shaft 10 is guided into the housing shells 2 and 3 via two bearings formed, for example, as grooved ball bearings 11. The shaft 10 is sealed on the left side in FIG. 2 by a shaft sealing ring 12. On the right side in FIG. 2, the grooved ball bearing 11 is held in a bearing socket 13.

On the drive shaft 10, a drive pinion 16 is arranged by means of a securing ring 14 and a sleeve 15. The drive pinion 16 engages with teeth provided on the outer periphery of a swash plate 17, which is supported rotatably on a shaft 18 in the housing 1. The drive pinion 16 and the swash plate 17 thus form an input gear unit of the pump.

The swash plate 17 has two tracks 19 concentric with the shaft 18 as a rotary-linear conversion gear unit, and these tracks have a height that varies in the peripheral direction. The pump element 5 is in contact with the inner of the two tracks 19, as is visible from FIG. 2, so that through rotation of the swash plate 17, the pump element delivers oil or the like, which is fed into the housing 1 via the inlet 7.

For receiving the force, which is exerted by at least one pump element 5 on the tracks 19 of the swash plate 17 and which acts in the axial direction of the shaft 18, a sliding plate 20 is arranged between the swash plate 17 and the housing 1.

In the shown embodiment, only a single pump element 5 is illustrated. However, after opening the predetermined breakage points, additional pump elements 5 can also be inserted into other openings 4.

As emerges, in particular, from the sectional view of FIGS. 2 and 3, the shell geometry of the two housing shells 2 and 3 is selected in such a manner that these can be easily removed from a mold by opening the die inserts of an injection-molding die. Therefore, the housing shells 2 and 3 can be produced very economically as plastic injection-molded parts.

It will be observed from the foregoing that a lubricant or hydraulic pump of this invention can be produced in an economical way and can have various uses. These advantages are achieved according to the invention essentially in that the housing is formed from two housing shells, which are of at least substantially similar construction and in which the drive element that is formed, for example, as a swash plate is arranged in such a way that one or more pump elements can be driven for delivering, for example, oil or the like. Through the use of structurally identical housing shells, the number of components to be maintained in the design of such a pump is significantly reduced. In this way, the costs for the production of a pump can be reduced.

If the housing shells are also constructed in such a way that a varying large number of pump elements can be provided, then the number of possible uses for the pump is increased.

In a refinement of the concept of the invention, it is provided that the housing is formed from two housing shells, which are, in particular, screwed to each other and which are identical at least before assembly of the housing. The two housing shells, which can be fixed to each other, in particular, in a mirror-image arrangement, can be produced especially economically by the large number of pieces. If necessary, for preparation or during assembly of the housing, one or two housing shells can be adapted individually to the conditions of use.

According to a preferred embodiment, the housing shells of the lubricant or hydraulic pump according to the invention each have several openings that are closed by means of predetermined breakage points before the assembly of the housing for installation of pump elements, drive or driven shafts, and/or inlets or outlets, and/or ventilation openings. Through the shaping of the housing shells with openings closed by means of predetermined breakage points, the housing shells can be completely closed, for example, before the assembly of the housing. In this case, during the assembly of the housing, only the openings required, for example, for inlets or outlets, shaft or pump elements, are opened at the predetermined breakage points. The other openings can remain closed, without having to provide separate closure plugs or the like. This simplifies the construction of the pump. However, it is also possible, for a change in the conditions of use, to reclose individual openings by means of plugs or the like or to open up new openings at the predetermined breakage points. The pump thus can have various uses.

It has proven especially advantageous if the housing shells have several openings for installation of pump elements. Thus, for example, four, six, eight, ten, twelve, or more openings that are advantageously closed by means of predetermined breakage points before assembly of the housing can be provided for the pump elements. Thus, the position of a pump element on the housing can be adapted to the conditions of use and the number of pump elements can also be varied. The housing shells can be used for a plurality of various pumps and can be produced especially economically in this way.

In particular, it is preferred if the openings in the housing shells, which are provided for the installation of pump elements, lie on at least one and, preferably, two paths concentric with the axis of the drive element. For such a construction of the housing shells, the driven element, which is constructed advantageously as a swash plate, can have at least one, in particular, two tracks arranged concentric with the axis of the drive element, with which tracks the at least one pump element interacts for delivering oil or the like. Thus, each pump element is moved back and forth at least once for one revolution of the drive element as a function of the shape of the tracks.

An especially economical and cost-effective production of the housing shells can be achieved in that these are formed as plastic injection-molded parts. Here, it is especially preferred if the housing shells can be easily removed from the die inserts of the injection-molding die. To allow this, the housing shells are formed, in particular, free from undercuts.

Within the lubricant and hydraulic pump according to the invention, an up-conversion gear unit or a down-conversion gear unit can be provided as a function of the conditions of use. Thus, on its outer peripheral surface, the drive element advantageously has teeth that engage with teeth of a drive pinion fixed on the drive shaft, so that an input gear unit is formed.

According to another embodiment of the invention, the drive element is arranged on a shaft with a free shaft end projecting out from the housing. The extension of the shaft of the drive element allows another pump, for example, a grease pump, to be driven with the free end of the shaft. Thus, several pumps can be connected in series.

Refinements, advantages, and possible applications of the invention emerge from the above description and the drawing. Here, all of the described and/or graphically illustrated features for themselves or in any combination form the subject matter of the invention, independent of their summarization in the claims or their relationship.

| Reference symbols | |
|---|---|
| 1 | Housing |
| 2, 3 | Housing shell |
| 4 | Opening |
| 5 | Pump element |
| 6 | (Ventilation) opening |
| 7 | Inlet |
| 8 | Screw attachment |
| 9 | Sealing ring |
| 10 | Drive shaft |
| 11 | Grooved ball bearing |
| 12 | Shaft sealing ring |
| 13 | Bearing socket |
| 14 | Securing ring |
| 15 | Sleeve |
| 16 | Drive pinion |
| 17 | Swash plate |
| 18 | Shaft |
| 19 | Track |
| 20 | Sliding plate |

What is claimed is:

1. A lubricant or hydraulic pump, comprising a housing formed from two housing shells which are of at least substantially similar or identical construction, an inlet provided on or in the housing, a drive element rotatably mounted in the housing and comprising a swash plate, and at least one pump element which interacts with the drive element for delivering oil, each housing shell having several predetermined breakage points comprising break-away portions of the housing shell configured to be broken away to form openings for installation of said at least one pump element, drive or driven shafts, and/or inlets or outlets, and wherein said openings remain closed by said break-away portions at least before assembly of the housing.

2. A lubricant or hydraulic pump according to claim 1, characterized in that said two housing shells are screwed to each other and are of substantially similar construction at least before assembly of the housing.

3. A lubricant or hydraulic pump according to claim 1, characterized in that the housing shells have at least six openings closed at least before assembly of the housing by said break-away portions.

4. A lubricant or hydraulic pump according to claim 1, characterized in that the housing shells have at least twelve openings closed at least before assembly of the housing by said break-away portions.

5. A lubricant or hydraulic pump according to claim 1, characterized in that several openings are provided in the housing shells for installation of more than one pump element, said openings being located on at least one path that is concentric with the axis of the drive element.

6. A lubricant or hydraulic pump according to claim 1, characterized in that several openings are provided in the housing shells for installation of more than one pump element, said openings being located on at least two paths that are concentric with an axis of rotation of the drive element.

7. A lubricant or hydraulic pump according to claim 1, characterized in that said swash plate comprises at least one track concentric with an axis of rotation of the drive element, said at least one pump element interacting with the track.

8. A lubricant or hydraulic pump according to claim 1, characterized in that said swash plate comprises at least two tracks concentric with an axis of rotation of the drive element, said at least one pump element interacting with a respective track.

9. A lubricant or hydraulic pump according to claim 1, characterized in that the housing shells are formed as plastic injection-molded parts that are free from undercuts.

10. A lubricant or hydraulic pump according to claim 1, characterized in that the drive element has an outer peripheral surface with teeth that engage with teeth of a drive pinion fixed on the drive shaft.

11. A lubricant or hydraulic pump according to claim 1, characterized in that the drive element is driven by the drive shaft with a free shaft end projecting out from the housing.

12. A packing press comprising a lubricant or hydraulic pump according to one of claims 1-11.

13. A lubricant or hydraulic pump according to claim 1, characterized in that said break-away portions are weakened portions of the housing shell.

14. A lubricant or hydraulic pump according to claim 1, characterized in that said break-away portions are weakened portions of the housing shell molded as integral parts of the housing shell.

* * * * *